US007339547B2

(12) United States Patent
Reid, Jr.

(10) Patent No.: US 7,339,547 B2
(45) Date of Patent: Mar. 4, 2008

(54) SATELLITE DISH COVER

(75) Inventor: Joseph Walter Reid, Jr., Vestavia Hills, AL (US)

(73) Assignee: Dish Rags, Inc., Birmingham, AL (US)

( * ) Notice: Subject to any disclaimer, the term of this patent is extended or adjusted under 35 U.S.C. 154(b) by 0 days.

(21) Appl. No.: 11/800,725

(22) Filed: May 7, 2007

(65) Prior Publication Data

US 2007/0205958 A1 Sep. 6, 2007

Related U.S. Application Data

(62) Division of application No. 11/247,676, filed on Oct. 11, 2005, now Pat. No. 7,215,300.

(60) Provisional application No. 60/623,833, filed on Nov. 1, 2004.

(51) Int. Cl.
*H01Q 1/42* (2006.01)

(52) U.S. Cl. ..... 343/872; 343/912; 343/840

(58) Field of Classification Search ..... 343/872, 343/840, 912; 705/1
See application file for complete search history.

(56) References Cited

U.S. PATENT DOCUMENTS 7,277,064 B2 * 10/2007 Hogsett ..... 343/872

* cited by examiner

*Primary Examiner*—Hoang V. Nguyen
(74) *Attorney, Agent, or Firm*—Bradley, Arant, Rose & White, LLP

(57) ABSTRACT

The present disclosure provides a satellite dish cover comprising a main body portion having a front side, a back side and an outer edge, and a securing element for securing said satellite dish cover to the concave face of a satellite dish. The securing element requires no manual adjustment in order to be secured to a satellite dish. The satellite dish cover may further comprise a design element, a color or a texture to increase the aesthetic appeal of the satellite dish cover.

20 Claims, 4 Drawing Sheets

SATELLITE DISH COVER

STATEMENT AS TO PRIORITY

The instant application is a divisional application of U.S. Non-Provisional Application No. 11/247,676, filed Oct. 11, 2005, now U.S. Pat. No. 7,215,300, issued May 8, 2007, which claims priority to and the benefit of U.S. Provisional Patent Application No. 60/623,833 filed Nov. 1, 2004.

FIELD OF THE DISCLOSURE

The present disclosure relates generally to devices for use with satellite dishes. The present disclosure relates particularly to a decorative and protective cover for use with satellite dishes.

BACKGROUND

Over the past decade, the use and prevalence of digital satellite communications systems in residential and business settings have increased dramatically. The use of satellite dishes allows a convenient and cost effective alternative to traditional cable-based systems for receiving information, such as entertainment content. In addition, satellite communications systems are also being used in non-traditional settings such as recreational vehicles and at outdoor gatherings, such as may be observed prior to sporting events. A variety of digital satellite communications systems are available to a consumer. However, generally, such systems comprise a satellite dish, a support for stabilizing the satellite dish and anchoring the same to a structure, a feeder horn supporter by an arm member, which is generally positioned in front of the satellite dish. The satellite dish collects and focuses signals transmitted from a satellite and directs such signals to the feeder horn, which transmits such signals to a satellite receiver where the signals are processed for display.

The increasing prevalence of satellite communications systems presents a problem to the user. For instance, many residential neighborhoods and business districts have regulations regarding the aesthetic appearance. The presence of a satellite communication system may violate such regulations, thereby preventing the user from subscribing to a satellite communication service. Due to the technical requirements for the operation of the satellite communication system, the components are often required to be placed in obtrusive locations which are visible to passersby. Furthermore, various contaminants from the environment (such as but not limited to, animal excrement, leaves and trash) may become lodged on a component of the satellite communications system and degrade performance of the system. This is especially true of the satellite dish. When such a situation occurs, the user is required to takes measures to restore the satellite communications system to working order by cleaning the components of the system or taking other corrective action. Since the components of the satellite communications systems must often times located in hard to access locations to ensure adequate signal reception (such as on the corner of or roof), gaining access to the components of the satellite communications systems is a time-consuming, difficult and sometimes dangerous task.

It would be advantageous to users of such satellite communications systems if devices were available to protect the components of the satellite communication system, in particular, the satellite dish. Furthermore, such devices would ideally offer an aesthetic element as well to make the appearance of the satellite dish as pleasing to the eyes as possible and be easy to maintain. Due to their location, satellite dish covers tend to become soiled over time during use requiring the covers be cleaned for optimal aesthetic value. Prior art satellite dish covers were made of materials that were hard to clean or contained attachments/accessories that could be damaged during the cleaning process. For example, the Pfnister patent provided a series of Velcro attachments to secure the device to the satellite dish while Gusik, Jr disclosed a drawstring device; with repeated cleaning these attachments/accessories may be damaged or become inaccessible. As discussed herein, if even damaging the devices during claiming was not an issue, the effort required to reach the satellite dish cover and remove the satellite dish covers makes simple maintenance a chore. The present disclosure provides a satellite dish cover that is easy to clean and simple to maintain. The disclosed cover is essentially "wash and wear" meaning the satellite dish cover can be cleaned (for example in a washing machine) without rear of damaging the cover (such as the Velcro of Pfnister and the drawstring of Gusik, Jr.

In addition, such devices: should be as simple to install as possible. This is particularly important since, as mentioned above, the components of the satellite communications systems are often installed in difficult reach locations. Therefore, the ease of installation of such devices would reduce the effort involved in installing such devices and reduce the potential harm to the user in installing such devices. Furthermore, such devices should be designed and constructed to remain on the satellite dish under a range of environment conditions, such as but not limited to, high winds and stormy conditions.

Finally, such devices should be designed and constructed to withstand a wide range of environmental conditions, such as but not limited to, extreme heat or cold temperatures, or high winds and stormy conditions, without losing the ability to remain secured to the satellite dish. For example, the satellite dish covers made of hard plastic will undergo repeated expansion and contraction as a result of normal temperature cycling during the day and during a change of seasons. Furthermore, such expansion and contraction may occur as a result of seasonal temperature changes. Due to this contraction and expansion, the satellite dish cover may become cracked, warped or the like and as a result may not remain secured to the satellite dish. The present disclosure provides a satellite dish cover that automatically adjusts to such environmental factors, such as but not limited to, temperature cycling, to remain secured to the satellite dish.

While the prior art has disclosed certain devices for the protections of the components of satellite communications systems, none of the devices provide or suggest the elements as disclosed herein. For example, rigid covers for satellite dishes have been known in the art. However, such rigid covers lack durability and tend to splinter, chip or crack when impacted by debris such as falling tree branches. Such rigid covers also are subject to contraction and expansion as a result of normal temperature cycling in the environment, which may further decrease the integrity of the rigid covers. Furthermore, U.S. Pat. No. 5,940,047 to Pfnister discloses a satellite cover and feeder arm cover. The disclosed device requires several manufacturing steps to complete and is difficult to install by a user requiring the user to manipulate a variety of Velcro closures to secure the cover to the satellite dish, greatly increasing the risk of injury to a user. Likewise, the satellite cover disclosed by Gusik, Jr. is also more difficult to install on a satellite dish than the satellite dish cover of the present disclosure requiring the user to manually adjust a drawstring to ensure the cover is secured to the satellite dish.

The present disclosure provides a satellite dish cover that is simple and efficient to manufacture, provides protection to a satellite dish without significant degradation of signal, which is easy to maintain, and which can be installed by a user without any type of manual adjustment. Therefore, the satellite dish cover of the present disclosure provides solutions to problems encountered in the area of satellite communications systems that were previously not appreciated in the art.

DETAILED DESCRIPTION

Figure 1:
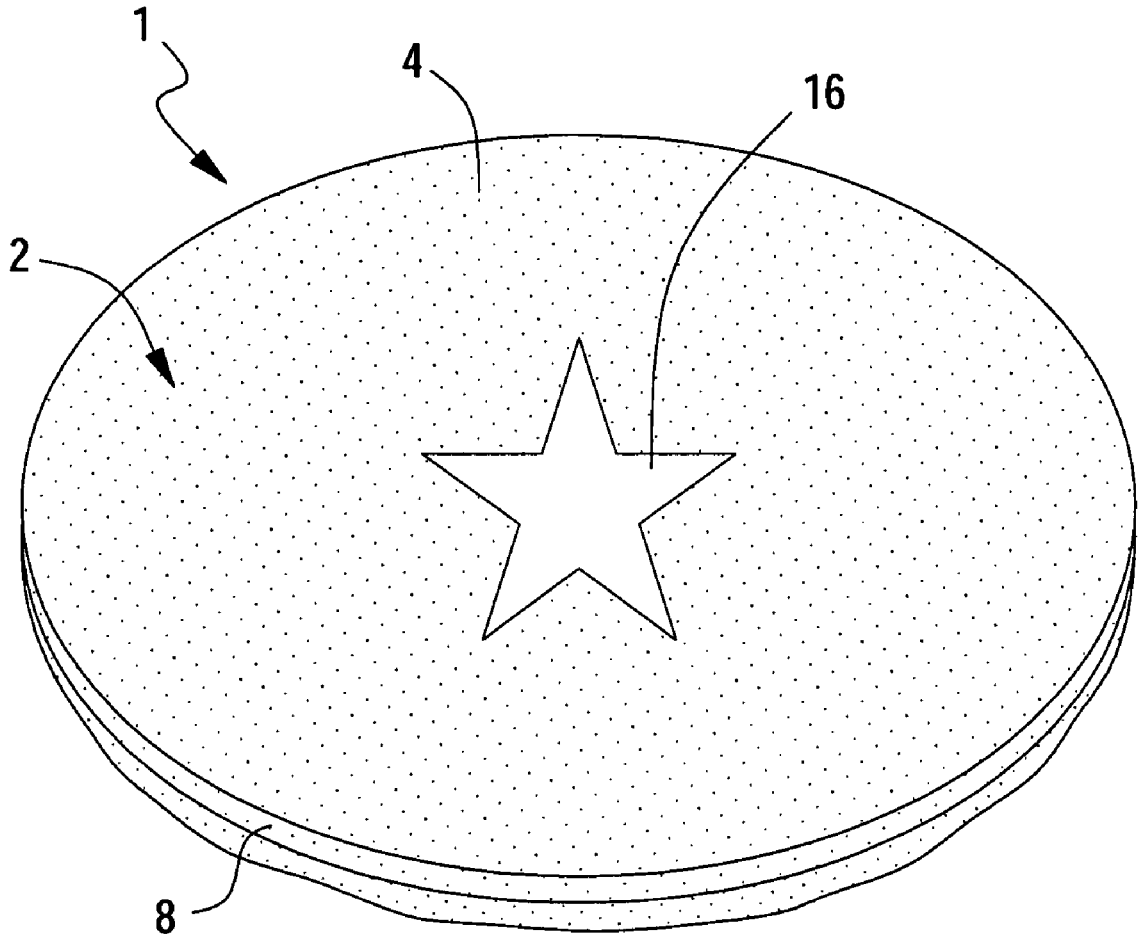
FIG. 1 is a top perspective view of one embodiment of the satellite dish cover of the present disclosure.

With reference to FIGS. 1-4, the satellite dish cover of the present disclosure will now be described. Although not claimed or described as an integral part of the satellite dish cover described herein, an exemplary satellite communication system (shown in FIG. 4 and labeled PRIOR ART) will now be described in order to more fully understand the features and operation of the disclosed satellite dish cover. The exemplary satellite communication system comprises a dish 100, a support 102 for stabilizing the satellite dish 100 and anchoring the same to a support, a feeder horn 104 supported by an arm member 106, which is generally positioned in front of the satellite dish 100. The satellite dish itself has a concave front portion 110, a convex back portion 112, said concave 110 and convex 112 portions joining at an edge 114 which defines the periphery of the satellite dish 100. Although an exemplary satellite communication system is described in FIG. 4, the present disclosure describes a satellite dish cover that may be used with any satellite dish currently developed or to be developed in the future.

Figure 2A:
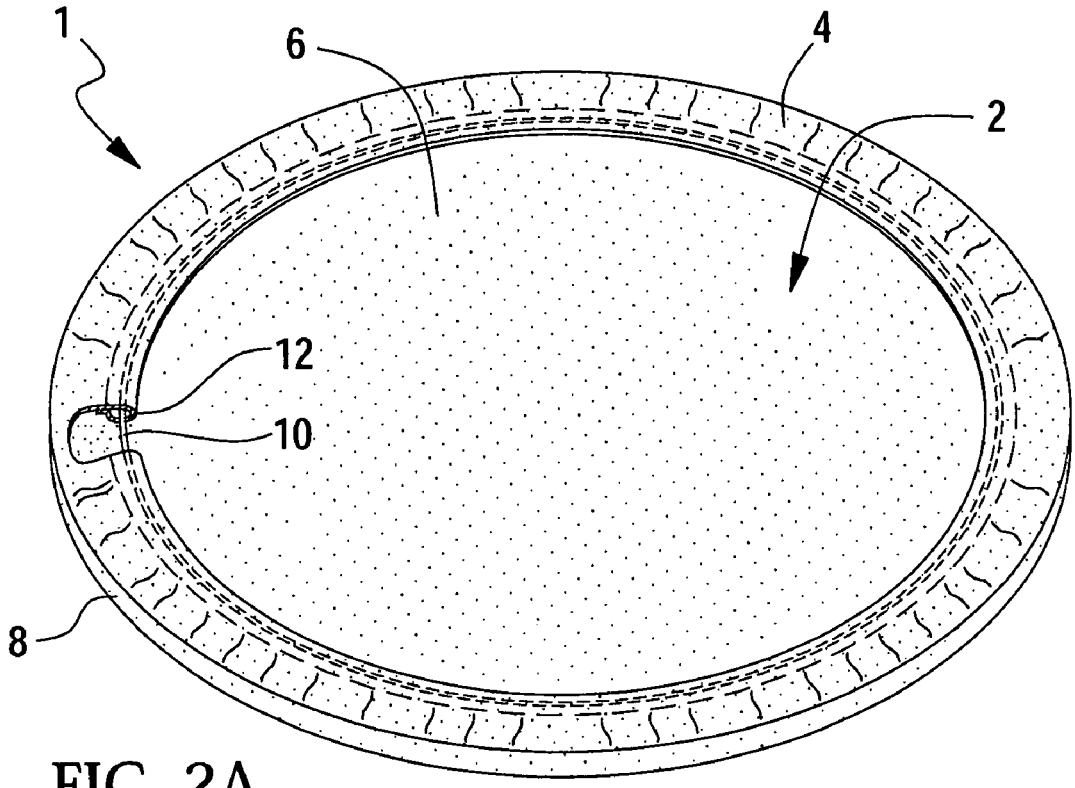
FIG. 2A is a bottom perspective view of one embodiment of the satellite dish cover of the present disclosure illustrating one embodiment of the securing means.
Figure 2B:
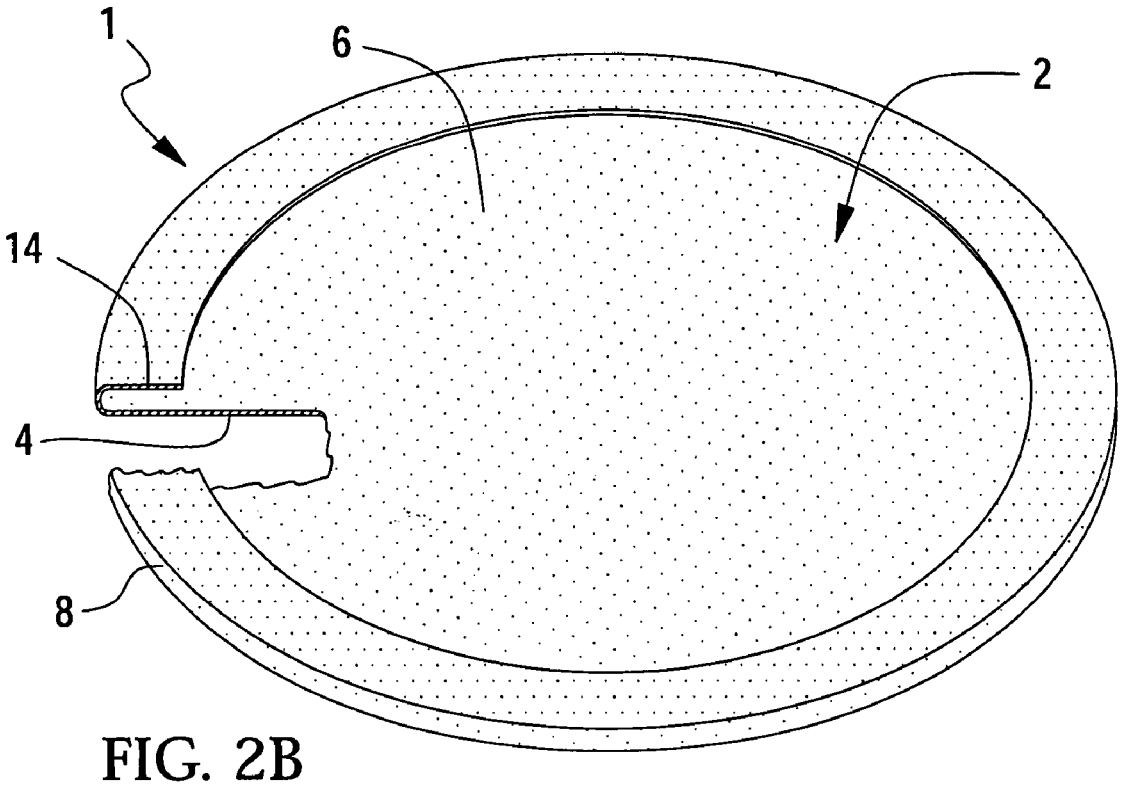
FIG. 2B is a bottom perspective view of one embodiment of the satellite dish cover of the present disclosure illustrating an alternate embodiment of the securing means.
Figure 3:
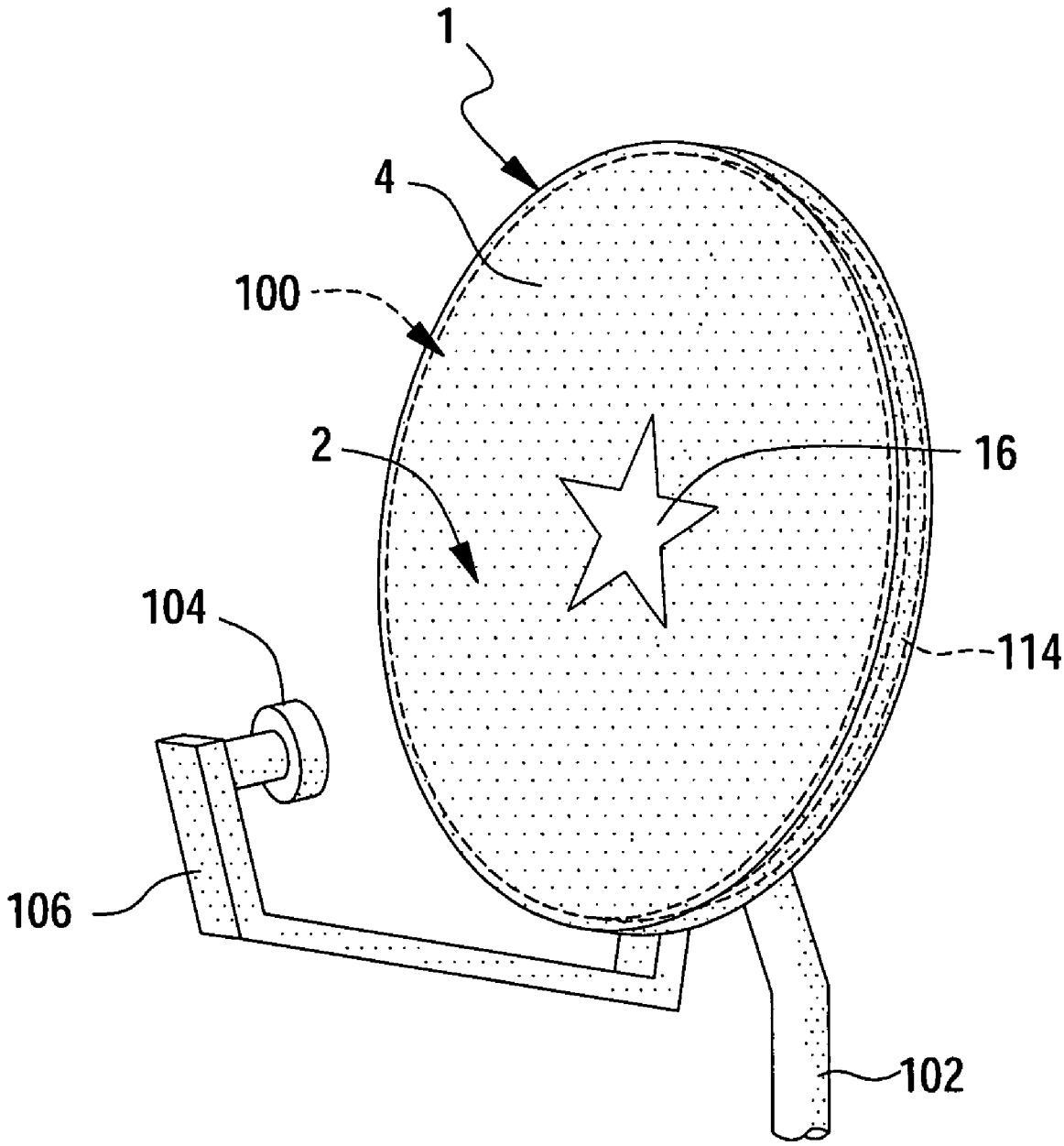
FIG. 3 is a front perspective view of one embodiment of the satellite dish cover of the present disclosure as mounted on a satellite dish.
Figure 4:
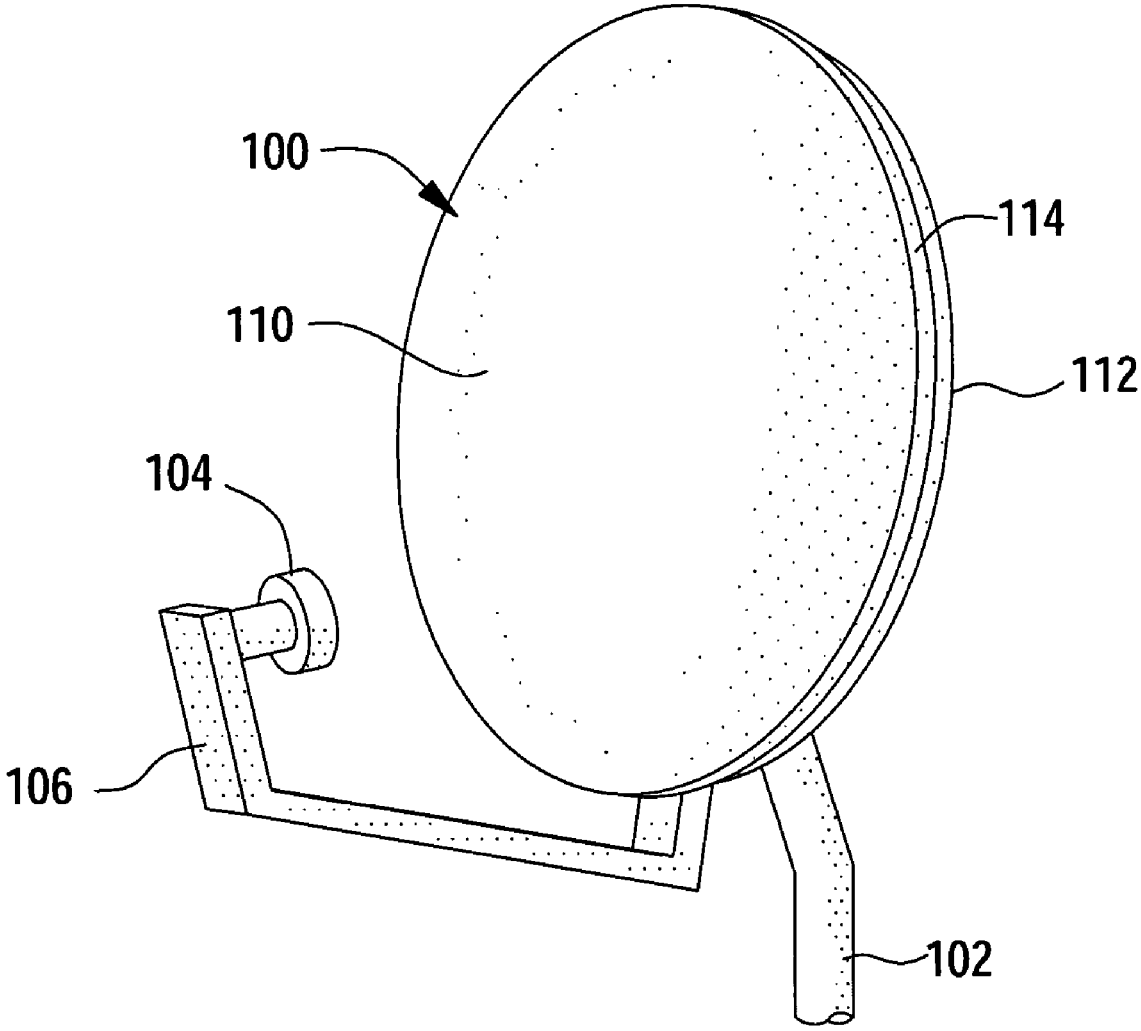
FIG. 4 (Prior Art)
FIG. 4 shows one embodiment of a satellite communication system as in known in the art.

The satellite dish cover, designated 1 is illustrated in FIGS. 1-3. The satellite dish cover 1 comprises a main body portion 2 having a front side 4, a back side 6, and an outer edge 8. The outer edge 8 defines the periphery of the satellite dish cover 1. The satellite dish cover 1 further comprises a securing element 10 on or adjacent to the outer edge 8 to secure the satellite dish cover 1 to the satellite dish 100. The securing element 10 may be any element that is capable of substantially returning to its original length after being stretched. In one embodiment, the securing element 10 is an elastic material. In an alternate embodiment, the securing element 10 is a spring. The front side 4 of the main body portion 2 may further comprise a color or a design element 16. The design element 16 is illustrated generically as a fictional sports logo.

The securing element may take various forms, provided that the securing element functions to secure the satellite dish cover 1 to the satellite dish 100 without manual adjustment of the securing element 10 by the user. In one embodiment, the securing element 10 is secured to the satellite dish cover 1 at or adjacent to the outer edge 8. In such an embodiment, the securing element 10 may be at least partially contained in a sleeve 12 secured to the satellite dish cover 1 at or adjacent to the outer edge 8. The sleeve 12 may tubular in nature and constructed from the same material as the main body portion 2. FIG. 2A illustrates a bottom perspective view of satellite dish cover 1 illustrating the sleeve 12 housing the securing element 10 (illustrated as an elastic material). The sleeve 12 may be continuous around the outer edge 8 or non-continuous around outer edge 8 so that all or a portion, respectively of the securing element 10 is contained within the sleeve 12. In one embodiment, the entire securing element 10 is contained within the sleeve 12.

In an alternate embodiment, the satellite dish cover 1 further comprises a lip 14 extending from the outer edge 8 and downward so that the lip 14 is positioned under the back side 6 of the main body portion 2. The lip 14 may be an integrated part of the main body 2 or may be secured to main body 2, such as by stitching or other means known in the art. In this embodiment, the lip 14 functions as the securing element 10. FIG. 2B illustrates a bottom perspective view of satellite dish cover 1 illustrating the lip 14. In one embodiment, the lip 14 is constructed of the same material as the main body portion 2. In an alternate embodiment, the lip 14 is constructed from a different material than the main body portion 14. When different materials are used for the lip 14, the elasticity of the material comprising the lip 14 and the main body portion 2 may be different or may be the same.

The main body portion 2 of the satellite dish cover 1 is constructed from a non-rigid material. Suitable non-rigid materials include but are not limited to fabric, plastics, or polymeric materials. The non-rigid material is selected so that the non-rigid material does not interfere with the satellite signal collection or transmission of such signal to the feeder horn 104. The non-rigid material may be an elastic material if desired. The aforementioned non-rigid materials may also be used when a non-rigid elastic material is desired for manufacture of the main body portion 2. In one embodiment, the lip 14 is constructed from a non-rigid elastic material in order to enhance the function of lip 14 as the securing element 10. Furthermore, the material used may be treated to be stain resistant to help maintain the satellite dish cover 1 in an aesthetically pleasing state. Furthermore, the material used to construct the main body portion 2 of the satellite dish cover 1 may be engineered to be stain resistant. Such a stain resistant fabric may be non-rigid and or elastic. Such an exemplary stain resistant material includes engineered material, such as but not limited to, materials made from nanofibers.

The circumference of the main body 2 is constructed to substantially match the circumference of the satellite dish 100. By "substantially match" it is meant that the circumference of the main body 2 is not greater than 35% of the circumference of the satellite dish 100. The circumference of the main body portion 2 may be less than the circumference of the satellite dish 100. It is not required that the circumference of the main body 2 match the circumference of the satellite dish 100 since the securing element will ensure the satellite dish cover 1 can be secured to satellite dishes 100 of varying circumferences.

The securing element 10 allows the satellite dish cover 1 to be placed on and secured to the satellite dish cover 100 without any manual modification or adjustment of the securing element 10 by a user. Such a satellite dish cover was not heretofore known in the art. In operation, the user places a portion of the satellite dish cover 1 over the convex face 102 of the satellite dish 100 so that the outer edge 8 of the satellite dish cover 1 is adjacent to the edge 114 of the satellite dish 100. The user then secures the remaining portions of the satellite dish cover 1 over the satellite dish 100 so that the outer edge 8 of the satellite dish cover 1 is adjacent to the edge 114 of the satellite dish 100. As the satellite dish cover 1 is placed over the satellite dish 100 as described, the securing element 10 of the satellite dish cover 1 is stretched to allow placement of satellite dish cover 1 over the satellite dish 100. When the satellite dish cover 1 is in position on the satellite dish 100, the securing means contracts to its original position, thereby securing the satellite dish cover 1 to the satellite dish 100. In such an operation, a user can place and secure the satellite dish cover 1 to a satellite dish 100 using just one hand. The ease of installation of the satellite dish cover 1 greatly reduces the potential for injury to the user when installing the satellite dish cover 1.

The satellite dish cover 1 may be manufactured in a variety of colors as desired. The color may be selected as desired by the user and may be selected so as to allow the satellite dish to blend in to its surrounding. For example, the color of the satellite dish cover 1 may be selected to match to color of the roof is mounted on a roof or to match the color of a residential or commercial structure is mounted thereon. Furthermore, the satellite dish cover 1 may be manufactured with a variety of textures to the material comprising the satellite dish cover 1. The use of different textures further enhances the aesthetically pleasing nature of the satellite dish cover 1. The satellite dish cover 1 may be manufactured so as to display a design element on its front side 4. The design element may serve to create a more aesthetically pleasing appearance to the satellite dish cover 1 or to help the satellite dish cover 1 blend into its environment. This may be especially desirable when the satellite dish cover 1 is in plain view of passersby. The design element may be any element capable of being reproduced on the satellite dish cover 1. In one embodiment, the design element is a logo, a pattern, a slogan, a word, a phrase, a flag, a scene, an animal, a fictional character, a person, a landscape, a graphic or the like. A logo may be any recognizable element representing a group or entity, such as, but not limited to, a sports team, a performing group or a business concern. A pattern may include any pattern desired, such as a geometric pattern, a pattern to simulate a run of bricks, a pattern to simulate shingles or other siding materials or a random pattern. A fictional character may include, but is not limited to, theme characters, such as cartoon characters, fairy tale characters and the like. In appropriate circumstances, permission to use a particular design element, such as a logo, may be obtained prior to placing the logo on the satellite dish cover 1. In still yet another embodiment, a color and a design configuration may be combined.

In one embodiment where the satellite dish cover 1 comprises a design element, the design element may serve as a form of advertisement for a business entity or other group desiring exposure. In such a use, the manufacturer of the satellite dish cover 1 identifies a third party interested in advertising on the satellite dish cover and offers the front side 4 of the main body portion 2 as advertising space for sell to the third party. The advertisement may then be placed a desired logo on the front side 4 of the main body portion 2 such that the advertisement is viewable by at least a portion of the public at large. The design element may be as described above. Such a system may be referred to as a method of advertising using the described satellite dish cover 1. For example, the provider of the satellite content, such as an entertainment provider, may wish to display its corporate logo on the satellite dish covers 1 provided with its service. Such a logo would serve an advertising function to the provider of satellite content.

What is claimed:

1. A method of advertising, said method comprising placing an advertisement on a satellite dish cover such that the advertisement is viewable by at least a portion of the public, said satellite dish cover constructed from a single piece of material comprising a main body portion having a circumference that substantially matches the circumference of a satellite dish, a front side, a back side and an outer edge, and a securing element for securing said satellite dish cover to the satellite dish, said securing element requiring no manual modification or adjustment of the securing element in order to be secured to the satellite dish.

2. The method of claim 1 where the advertisement is placed on the front side.

3. The method of claim 1 where said main body portion is manufactured from a non-rigid material.

4. The method of claim 3 where the non-rigid material is also an elastic material.

5. The method of claim 3 where the non-rigid material is a fabric, a plastic or a polymeric material.

6. The method of claim 3 where the non-rigid elastic material is a polymeric material.

7. The method of claim 1 where the satellite dish cover does not substantially interfere with a collection of a satellite signal being directed to the satellite dish.

8. The method of claim 1 where the securing element is an elastic element.

9. The method of claim 1 where the securing element is an elastic material or a spring.

10. The satellite dish cover of claim 1 where said cover is manufactured with a design element, a color, a texture or a combination of the foregoing.

11. The method of claim 1 further comprising contacting a third party interesting in placing an advertisement on said satellite dish cover.

12. The method of claim 1 where said placing is provided for a fee.

13. The method of claim 1 where advertisement comprises a design element.

14. The method of claim 13 where the design element is a logo, a pattern, a slogan, a word, a phrase, a flag, a scene, an animal, a fictional character, a person, a landscape or a graphic.

15. The method of claim 14 where the logo is a recognizable element representing a group or entity.

16. The method of claim 15 where the group or entity is a sports team.

17. The method of claim 15 where the group or entity is a business.

18. The method of claim 15 where the group or entity is an organization.

19. The method of claim 15 where the group or entity is a performing group.

20. The method of claim 14 where the person is a politician.

* * * * *